United States Patent [19]

Wildfeuer

[11] 4,283,925

[45] Aug. 18, 1981

[54] SYSTEM FOR COOLING

[76] Inventor: Robert Wildfeuer, 85 Floral Dr., W. Plainview, N.Y. 11803

[21] Appl. No.: 94,743

[22] Filed: Nov. 15, 1979

[51] Int. Cl.[3] ..... F25D 43/02

[52] U.S. Cl. ..... 62/434; 62/332; 165/104.17

[58] Field of Search ..... 62/332, 333, 430, 434; 165/104 S, 104 M

[56] References Cited

U.S. PATENT DOCUMENTS

| | | | |
|---|---|---|---|
| 3,603,379 | 9/1971 | Leonard,Jr. | 62/333 |
| 3,773,031 | 11/1973 | Laing et al. | 165/104 S |
| 3,869,870 | 3/1975 | Kuechner | 62/114 |
| 3,906,742 | 9/1975 | Newton | 62/114 |
| 4,099,558 | 7/1978 | Bricard et al. | 165/104 S |
| 4,142,576 | 3/1979 | Perry et al. | 165/104 S |

*Primary Examiner*—Ronald C. Capossela
*Attorney, Agent, or Firm*—Evelyn M. Sommer

[57] ABSTRACT

A cooling system particularly suitable for use in the air-conditioning of buildings is described. The system includes:

(a) A cooling zone containing a conduit for cooling fluid, the conduit encountering the heat load, means in the conduit for propelling the fluid through the conduit, and cooling fluid in the conduit;

(b) A refrigeration zone containing a closed refrigeration circuit for refrigerant, chiller means in the circuit for extracting energy from the refrigerant, means for circulating refrigerant in the circuit and refrigerant in the circuit; and (c) Collection means connected to the refrigeration zone for removing energy extracted by the chiller.

The cooling and refrigeration zones are connectable through a heat exchanger for transfer of energy between the fluid and the refrigerant. The refrigeration circuit includes a reservoir constituting part of its zone. In that reservoir there are capsules containing a storage medium having a liquid/solid phase transformation point between the minimum and maximum operation temperatures of the refrigerant. These capsules provide a reverse cooling capacity for use during cyclic requirements therefor.

12 Claims, 2 Drawing Figures

SYSTEM FOR COOLING

BACKGROUND AND SUMMARY OF THE INVENTION

This invention relates to a system for the cooling of structures or other enclosures. It is especially suitable for situations where cooling requirements, or the "load", may vary substantially. It is therefore particularly useful for the air-conditioning of building structures.

The minimization of requirements for operating cooling systems of all kinds has become increasingly important with the recent rise in related costs. One means for doing so would be to overcome the drawbacks of cycles inherent in the operation of these systems. Unfortunately, these means are not readily available.

There are two main cycles that have contributed to these costs. First, cooling requirements are sporatic. To meet them, it has been necessary to provide refrigeration or chiller equipment having a capacity substantially over average cooling requirements. Thus excess capital investment has been needed to meet peak load requirements. Second, power costs fluctuate with general demand and cooling requirements ordinarily parallel that demand. As a consequence, maximum rates are generally paid for power utilized in cooling.

The present invention seeks to overcome these prior art problems through an integrated system involving build-up of an efficient, reserve cooling capacity. This capacity may be generated during low-load periods of time at which power costs are minimal. Through this system, smaller and less costly refrigeration equipment can also be employed to meet even peak cooling load requirements.

These objectives may be achieved utilizing equipment primarily derived from conventional cooling systems. Such systems normally include three zones. These are: a cooling zone; a refrigeration zone; and a heat collection (or dissipation) zone.

The cooling zone is normally essentially co-extensive with the boundaries of the enclosure to be cooled. Thus, for example, in an office building, it would generally encompass the entire work space.

This zone should contain a conduit (or conduits) for conveying a cooling fluid and means for propelling the fluid through the conduit(s) to where the load occurs. Many such embodiments are readily apparent. Most buildings, for example, utilize forced air blown through conduits into individual rooms. In other situations, such as a freezer, recirculating fluids may be pumped through walls, or pipes in walls, surrounding the materials to be cooled. All these forms are compatible with the present invention.

The heat collection or dissipation zone is normally quite separate from the cooling zone. It is utilized to remove energy extracted from refrigerant by the chiller means in the refrigeration zone. All that is required for this zone is a collection means, many of which are again conventional. They may, for example, simply constitute an air cooled condenser, a standard building cooling tower or other heat rejection devices. For conservation of energy, it is preferred that the zone be one which transfers the energy to another use. Thus it may include a commercial converter means utilized for concentrating energy and producing, for example, hot water for the building.

Between the heat collection (or dissipation) means and the cooling zone is the refrigeration zone. In overall perspective, it functions to extract energy from the cooling fluid while exhausting energy to the collection means. The present refrigeration zone, like many conventional ones, should contain a closed refrigeration circuit, means for circulating refrigerant therein and chiller means within the circuit for removal of energy from the refrigerant.

In addition, the refrigeration zone of this invention contains a storage reservoir within the circuit. This reservoir is desirably large enough to store a substantial portion of the total daily cooling zone load requirements, preferably over 50% and most preferably over 90%. The reservoir is generally thermally insulated and, in the case of use for air-conditioning buildings or the like where it may be very large and heavy, is located securely, as in the basement.

In accordance with the present invention, the reservoir contains a number of discrete capsules of an energy storage medium. The medium is relied upon for storage of cooling capacity both through change in temperature and through liquid/solid phase transformation. This transformation allows storage of a latent cooling capacity equal to the enthalpy of solidification (or crystallization) of the medium.

The medium itself may be virtually any which is capable of a liquid/solid phase transformation within the operating range of the refrigeration zone. The most preferred liquid phase medium is water or an aqueous solution. The selection of a particular storage medium is also dependent upon the refrigerant employed. Of necessity, the phase transformation point of the medium must be slightly above (normally at least about 5 Centigrade degrees) the minimum temperature reached by the refrigerant during operation. It must similarly be below the maximum temperature reached.

Where—as in many air-conditioning systems—the refrigerant is aqueous, the storage medium is also preferably aqueous. To permit operation, it is then necessary that their two freezing points be different. This is readily accomplished by incorporation of different amounts of freezing points depressants into them.

In addition to formation of ice from an aqueous storage medium during operation, ice may also occur in an aqueous refrigerant. To avoid need for precautions—e.g. constant turbulent flow of refrigerant—this freezing is desirably controlled. Thus while all of a storage medium may be frozen, it is preferred that no more than 50%, preferably less than 30% of an aqueous refrigerant be ice at any given time. This insures its fluidity during operation.

The size of capsules utilized may vary widely. To facilitate energy exchange, the capsules ought to have at least one dimension of from 1 to 25, most preferably 5 to 15 centimeters. While the capsules may be irregular in shape, spherical ones are more desirable to insure refrigerant circulation and maximum surface contact.

The number of capsules present in the reservoir depends on the desired storage capacity, specific medium utilized and size of the capsules. It is therefore largely a matter of engineering design. Where both refrigerant and medium are aqueous-based, however, volume ratios of between 20 and 70% of refrigerant by volume of storage medium are, for example, preferred.

The storage medium may be encapsulated within almost any material capable of forming a thin membrane or like barrier to the medium. Such a membrane is ordinarily between 1 and 5 mm in thickness. The material may be either flexible or rigid. Most commonly a flexible plastic film is employed. Encapsulation itself is normally preformed by either injecting storage medium into a preformed capsule or by filling an appropriate envelope and then sealing it to contain the medium.

Due to the fact that many suitable media—such as water or aqueous-based liquids—undergo expansion or contraction with change in phase, the capsules should be capable of accommodating any change in its volume. Suitable means for achieving this objective are, however, well-known. The encapsulating material may, for example, be elastic. Alternatively, the capsule may contain a gas pocket, a compressible solid or another, compensating composition which allows for such a change in the medium.

The capsules of the present invention generally occupy a substantial volume of the reservoir. Desirably this is from 60 to 90% of its volume. Refrigerant may then be passed through and/or held in, the remaining intersticial volume of the reservoir. By this means a close proximity suitable for energy exchange between the capsules and refrigerant is obtained.

During operation, refrigerant may be passed at a rapid rate through the mass of capsules in the reservoir. In the event of channeling of refrigerant between reservoir inlet and outlet, the efficiency of energy exchange may be significantly reduced. It is therefore preferred to include baffles within the reservoir. These elongate the pathway of refrigerant.

Such baffles commonly take the form of plates or other partial barriers to flow of refrigerant. They may be placed tangential to a direct line between inlet and outlet (or even form a maze) to cause the refrigerant to take an elongated pathway. Refrigerant then permeates the intersticial volume of the reservoir more completely and maintains an essentially homogeneous temperature throughout the reservoir.

Any of the well-known or conventional refrigerants may be utilized. These include freon, water and the like. In preferred embodiments, it comprises water or a slurry of ice and water. Where desired to permit minimal operation temperatures it may additionally contain a freezing point depressant such as glycol (generally from about 5 to 50% by volume), salt (such as NaCl, $CaCl_2$, KF or $Na_2SO_4$) or the like. This permits the aqueous refrigerant to remain fluid at lower temperatures and so increases the cooling capacity of the system.

The refrigeration zone may actually be composed of two or more sub-circuits. Most efficient operation results where there is a sub-circuit including the chiller means and another connectable to the cooling zone. These sub-circuits must overlap partially and most commonly through mutual access to the storage reservoir. Refrigerant may be shifted therebetween by conventional valves.

When in the storage phase of operation, a reserve cooling capacity is generated in this zone. As the temperature of the refrigerant is reduced, the energy storage medium in the reservoir capsules is first cooled and then caused to undergo solidification. Where the medium is aqueous, as for example preferred, this results in the formation of ice. The amount of ice in the capsules of the reservoir varies cyclically. During the storage phase where more and more water is frozen, it approaches 70% to 99%. It may at other times fall to none, although normally the amount ranges between 10 and 99%.

As previously described, ice may also be formed in an aqueous refrigerant during this phase. A refrigerant comprising a slurry of water and ice which contributes a further latent cooling capacity then results. Unlike the storage medium, however, the refrigerant must remain fluid. Less ice can therefore be formed in it.

This storage phase of operation is performed primarily at times of minimum load requirement and lowest power cost. Both times generally coincide with night or other non-work periods. As a result, there is ample opportunity in which slowly to store a reserve cooling capacity (thereby reducing the capacity requirement for the chiller means) while saving on power.

When load requirements increase—normally during day time and working hours—and operation shifts to the cooling phase, it may not even be necessary to power the chiller means. Except under a very high load, there will be sufficient capacity stored in the reservoir to provide cooling throughout the day. This is not to say, however, that the chiller cannot be operated to yield auxiliary cooling during peak load periods in conjunction with reliance upon the stored capacity.

During the cooling phase, the refrigerant is cycled to permit connection with the cooling zone. This is easily accomplished by simultaneously passing the cooling fluid and the refrigerant through, for example, a conventional heat exchanger means. There the refrigerant reduces the temperature of the cooling fluid.

As energy is extracted from the cooling fluid, there is a consequent increase in the energy level of the refrigerant. In accordance with the present invention, the reserve cooling capacity in the capsules may be utilized to remove this energy and permit reuse of the refrigerant. Refrigerant recycled through the reservior is regenerated by a second indirct heat exchange with the encapsulated storage medium.

Of course, if the refrigerant also contains ice or similar liquifiable solids, the solid will melt during this phase of operation. This extra ice increases the efficiency of the refrigerant far beyond what would be expected from the difference between the temperature of the refrigerant and that of the cooling fluid.

The novel features of the invention, as well as additional objects and advantages thereof, will be understood more fully from the following description when read in conjunction with the accompaning drawing.

DESCRIPTION OF THE DRAWING

FIG. 11 is a cross-sectional view of the capsule.

In FIG. 1, the three primary zones of the system are depicted by dashed boxes. They are the cooling zone 1, the refrigeration zone 11, and the energy collection zone 12. The cooling and refrigeration zones 1 and 11 are shown operationally connectable through heat exchanger means 2. Collection means 30 of zone 12 may be directly affixed to the chiller means 28 of refrigeration zone 11.

Figure 1:
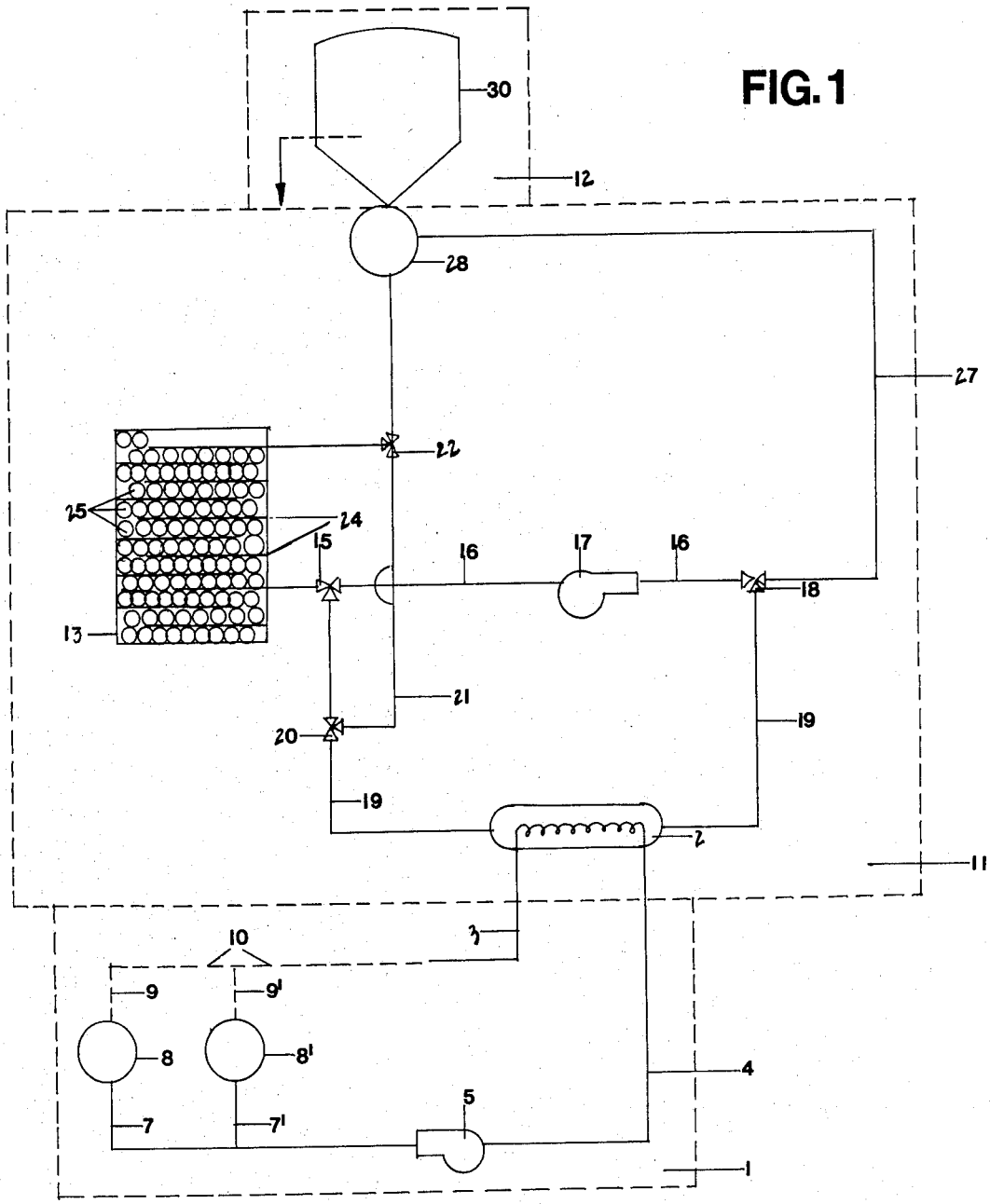
FIG. 1 is a diagrammatic view of the cooling system of the present invention.
Figure 2:
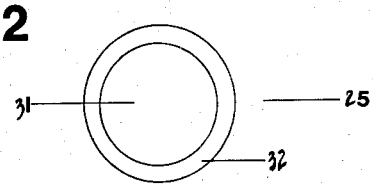

Most central to the present invention is the refrigeration zone 11. In its cooling phase of operation, the refrigerant exits the storage reservoir 13 by pipe 14 through a control valve 15 and pipe 16 containing a pump 17. It then passes through control valve 18 from which it is directed via pipe 19 into heat exchanger 2 which connects this sub-circuit of zone 11 with cooling zone 1.

The return refrigerant continues through pipe 19 from heat exchanger 2 to variable control valve 20. Most simply, all the refrigerant is then directed from control valve 20 via pipe 21 through valve 22 and back into the storage reservoir 13 by means of pipe 23. This completes the cooling phase sub-circuit because, as depicted, reservoir 13 constitutes a simple insulated holding tank, throughout which the refrigerant is free to pass.

The reservoir 13 is shown containing numerous energy storage capsules 25. Also depicted are a series of baffles 24 forming a maze-like (which may or may not be required) configuration which extends the flow path of refrigerant between and around the capsules 25 to increase the efficiency of energy exchange.

In the above-described refrigeration zone 11, there is also depicted pipe 26 connecting pipe 19 directly with pipe 16 via valves 20 and 15. Pipe 26 by-passes the reservoir 13 and may be utilized to moderate the total cooling system. Refrigerant returning from the cooling heat exchanger 2 via pipe 19 generally has a lower unit cooling capacity that refrigerant exiting directly from the reservoir 13. By means of variable control valve 20, some of the returning refrigerant may be reconveyed via pipe 26, to mix with fresh reservoir refrigerant in valve 20, for cycling to the heat exchanger 2 as already described or, as described below, to the refrigeration sub-circuit of refrigeration zone 11.

In the refrigeration phase of operation, refrigerant may also exit the storage reservoir 13 via pipe 14, valve 15 and pipe 16. At control valve 18, it is directed into the second sub-circuit through pipe 27 to chiller 28 which is normally either a centrifugal or screw machine refrigeration compressor, condenser and chiller combination. There energy is removed from the refrigerant to reduce its temperature. The chiller thus yields a refrigerant having an increased cooling capacity and which is returned to the reservoir 13 via pipe 29 and through control value 22 and then pipe 23.

To extract energy from the refrigerant, the chiller 28 must be connected to a heat collection (or dissipation) means 30. As previously described, this means 30 may range broadly in construction from something as simple as ventilators exposed to the air to something as complicated as a standard building cooling tower, a conventional closed circuit industrial cooler, or a heat recycling system. For the purpose of this invention, only this means 30 is required for the collection zone 12 and it is necessary only that it permit the continued operation of the chiller 28.

Returning to operation of the system during the cooling phase, refrigerant passing through heat exchanger means 2 operates to transfer energy from the separate cooling fluid of zone 1. That fluid, which may be water, air or any other conventional fluid is introduced into the heat exchanger 2 by an appropriate conduit 3. After being cooled to the desired temperature by indirect contact with refrigerant, it exits exchanger means 2 through conduit 4 under a force provided by a pump (or blower depending on the fluid) 5. The cooled fluid is then passed via conduit 6 to any number of separate conduits (herein depicted are two, 7 and 7') which may separately administer corresponding loads 8 and 8' where cooling is desired.

Depending upon the fluid and cooling mode actually employed, fluid may be recycled after encountering the load (8 and 8') through feed return conduits 9 and 9' to a collector return conduit 10 and finally back to conduit 3. Representative of this mode, for example, would be use of a liquid coolant fluid such as water in closed, recirculation. As represented by the use of dotted lines, however, conduits 9, 9' and 10 are optional and may not be present for simple air-conditioning. There, the load represented by a given room to be cooled would generally be met by exhausting cool air into the room. New air would be simultaneously introduced through conduit 3 from a different source to replace it.

In FIG. 11, a typical spherical capsule 25 is depicted in cross-section. The capsule 25 is composed of a thin membrane 32 of elastic material which envelops the storage medium 31. During phase transformation of medium 31, membrane 32 expands or contracts as required by change in volume.

The present system has been described with particular attention to use as an air-conditioning system for office and other buildings. For this embodiment, it is anticipated that the refrigerant would desirably be a mixture of water and about 40% glycol. The cooling capacity of refrigerant cycled for connection with the separate cooling zone could then be moderated through rates of flow, admixture with refrigerant from other parts of the closed refrigeration zone or combinations thereof.

The present system offers a particularly unique solution to prior art problems. Most especially it unites a highly effective energy storage capacity, including latent melt enthalpy reserves, with reduced equipment requirements which permit operation over extended periods of time when power expenses are at their minimum. This integrated combination of elements and their attendant advantages offers at least equivalent results for much less than was heretofore required.

While various preferred embodiments of this invention have been illustrated and described, it will be understood by those in the art that changes and modifications may be resorted to without departing from the spirit and scope thereof.

What is claimed is:

1. In a system for cooling an enclosure having a cooling load comprising:

(a) A cooling zone containing a conduit in said enclosure for cooling fluid, said conduit encountering said load, means in said conduit for propelling said cooling fluid through said conduit and cooling fluid within said conduit;

(b) A refrigeration zone containing a closed refrigeration circuit for refrigerant, chiller means in said circuit for extracting energy from said refrigerant, means in said circuit for circulating said refrigerant and refrigerant within said circuit; and (c) Collection means connected to said refrigerant zone for removing energy extracted by said chiller means; said refrigeration and cooling zones being connectable by an exchanger means for transferring energy from said cooling fluid to said refrigerant; the improvement wherein said refrigerant circuit includes a reservoir for said refrigerant, which reservoir contains capsules of an energy storage medium enveloped within an impermeable membrane, said medium having a liquid/solid phase transformation point at a temperature between the minimum and maximum operation temperatures of said refrigerant.

2. The system of claim 1, wherein the refrigeration circuit is composed of two sub-circuits, the first said sub-circuit including the chiller means; the second said sub-circuit including the exchanger means.

3. The system of claim 2, wherein both of the two sub-circuits include the storage reservoir.

4. The system of claim 2, wherein the two sub-circuits are interconnected for simultaneous operation.

5. The system of claim 4, wherein the two sub-circuits are interconnected for direct transfer of refrigerant from one to the other, exterior of the storage reservoir.

6. The system of claim 2, wherein the conduit of the cooling zone is a closed recirculation conduit.

7. The system of claim 2, wherein the conduit of the cooling zone is an open, non-continuous conduit.

8. The system of claim 2, wherein the collection means dissipates energy to the environment.

9. The system of claim 2, wherein the collection means recycles energy for use.

10. The system of claim 2, wherein the storage medium and refrigerant comprise water, said refrigerant further containing a freezing point depressant.

11. The system of claim 10, wherein the refrigerant comprises a slurry of ice and water.

12. The system of any on of claim 1, wherein the enclosure is a building and said system is an air-conditioning system.

* * * * *